US008063292B2

(12) United States Patent
Lin

(10) Patent No.: US 8,063,292 B2
(45) Date of Patent: Nov. 22, 2011

(54) SPEAKER STRUCTURE

(76) Inventor: Wei Liang Lin, Tainan County (TW)

( * ) Notice: Subject to any disclaimer, the term of this patent is extended or adjusted under 35 U.S.C. 154(b) by 754 days.

(21) Appl. No.: 12/190,440

(22) Filed: Aug. 12, 2008

(65) Prior Publication Data

US 2009/0092272 A1 Apr. 9, 2009

(30) Foreign Application Priority Data

Oct. 3, 2007 (TW) ..... 96216521 U

(51) Int. Cl.
*H04R 1/02* (2006.01)

(52) U.S. Cl. ..... 84/386; 381/388; 381/433

(58) Field of Classification Search ..... None
See application file for complete search history.

(56) References Cited

U.S. PATENT DOCUMENTS

2006/0278093 A1* 12/2006 Biderman et al. ..... 99/282
2009/0092272 A1* 4/2009 Lin ..... 381/336

* cited by examiner

*Primary Examiner* — Marlo Fletcher
(74) *Attorney, Agent, or Firm* — WPAT, P.C.; Anthony King

(57) ABSTRACT

A speaker structure contains a removable food container as a resonant box. The speaker structure contains a baffling device. The baffling device contains a baffle and means for retaining an open top of the food container that is attached to the baffle. When the food container is incorporated with the baffling device, the food container works as a conventional resonant box. Furthermore, a user can freely remove the food container from the baffling device and the removed food container may serve its original food-containing function.

18 Claims, 9 Drawing Sheets

SPEAKER STRUCTURE

FIELD OF THE INVENTION

This invention relates generally to a speaker structure, in particular to a speaker structure containing a removable food container as a resonant box.

BACKGROUND OF THE INVENTION

Compared to an un-baffled speaker, a baffled speaker has a thicker and more balanced bass performance. The sound pressure between the two can be as high as 100 times. Therefore, a speaker structure must to be baffled to produce a complete bass sound.

FIG. 1 illustrates a conventional speaker structure 100, which generally is composed of a speaker unit 110 for generating sound and a resonant box 120 for accommodating the speaker unit 110, wherein the top of the speaker unit 110 is generally flush with a side of the resonant box 120. The speaker unit 110 includes a diaphragm 111, a damper 112, a magnetic member 113, a voice coil 114 and a frame 115. The diaphragm 111, damper 112, magnetic member 113 and voice coil 114 are mounted onto the frame 115. The voice coil 114 is located on one end of the diaphragm 111 corresponding to the magnetic member 113, and located in the magnetic field generated by the magnetic member 113. When the electric signal passes through the voice coil 114, a magnetic force alteration occurs that interacts with the magnetic field of the magnetic member 113. The voice coil 114 alters according to the electronic signal. Also, the magnetic member 113 is attracted or repulsed in order to drive the diaphragm 111 outwards or inwards and lead to a conical portion of the diaphragm 111 moving like a piston, thus generating acoustic waves by compressing or releasing air. The resonant box 120 at the rear end of the speaker unit 110 aims to prevent offsetting of the air pressure alterations in front of the diaphragm 111 and on the rear side of the diaphragm 111. However, the resonant box 120 is fixed to the speaker unit 110 and thus cannot be used for other purposes.

Appliances that serve many purposes are useful to people. For example, they can save space and entertain people. Therefore, if a speaker structure contains a removable food container as a resonant box and the food container can be used for holding things such as coffee when removed from the speaker structure, it will be appreciated.

SUMMARY OF THE INVENTION

It is an object of the present invention to provide a speaker structure wherein the resonant box can be easily detached from a speaker unit and is a removable food container, and when the food container is removed from the speaker structure, it can serve its original purpose for containing things such as coffee.

The present invention in one embodiment relates to a speaker structure. The speaker structure mainly contains a food container and a baffling device. The food container has an open top, a bottom, a continuous circumferential wall extending between the top and the bottom, and a hollow space therein. The baffling device is for covering the food container, and contains: a baffle formed with an opening therein for accommodating a speaker unit, means for retaining the open top of the food container, a support portion connected with the baffle, and a biasing portion, connected with the support portion. The means is attached to an inner side of the baffle and the biasing portion is configured to retain the bottom of the food container and resiliently bias the open top of the food container toward the baffle of the baffling device, so that the food container can be firmly attached to the baffling device. The food container is removable from the baffling device. When the food container is attached to the baffling device, the food container works as a resonant box for the speaker unit, and when the food container is detached from the baffling device, the food container is for holding food in the hollow space.

BRIEF DESCRIPTION OF THE DRAWINGS

The above objects and advantages of the present invention will become more apparent from an ensuing description of preferred embodiments thereof with reference to the attached drawings, in which.

DETAILED DESCRIPTION OF THE PREFERRED EMBODIMENTS

Figure 1:
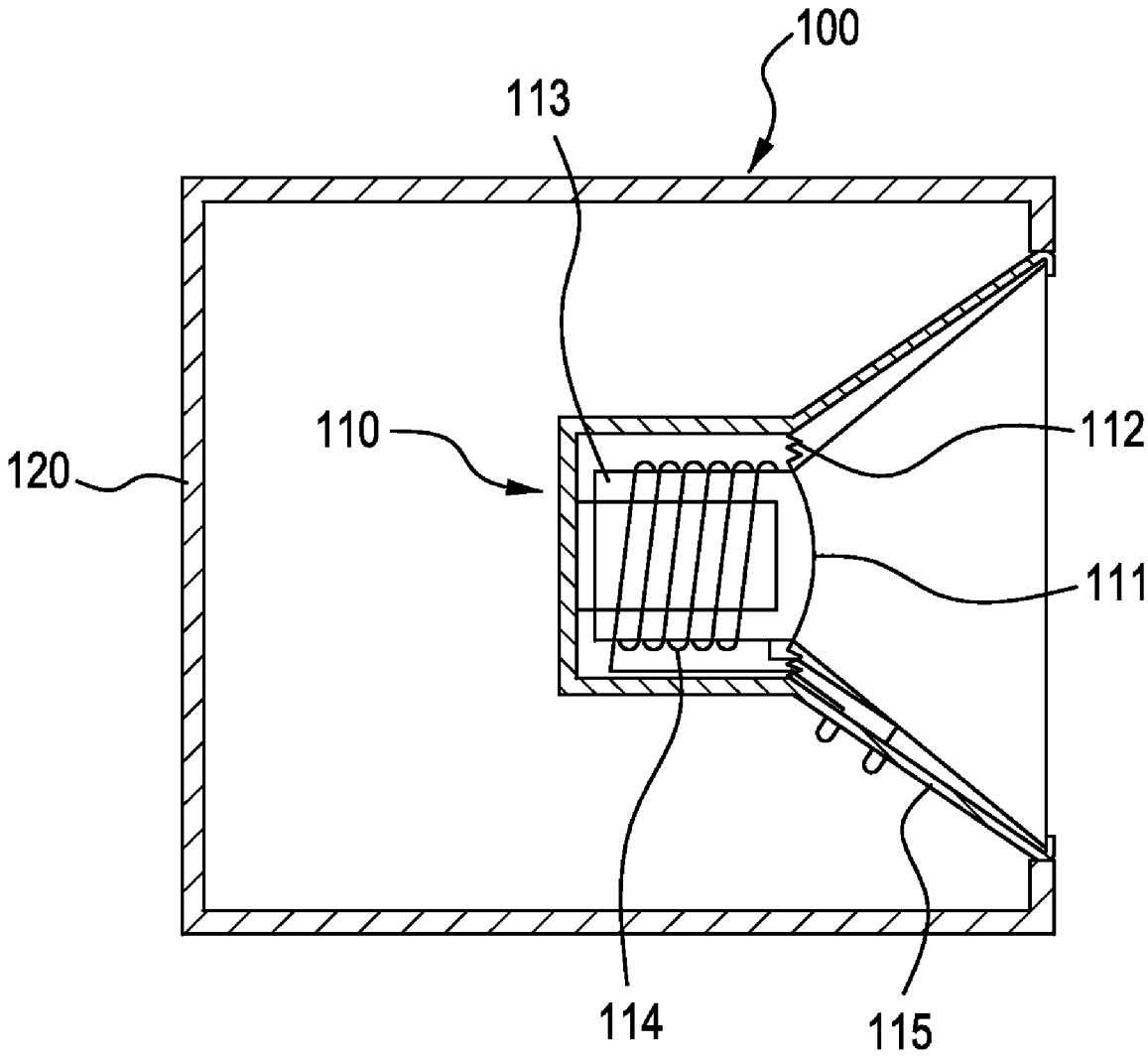
FIG. 1 (PRIOR ART)
FIG. 1 is a cross-sectional view of a conventional speaker structure.
Figure 2:
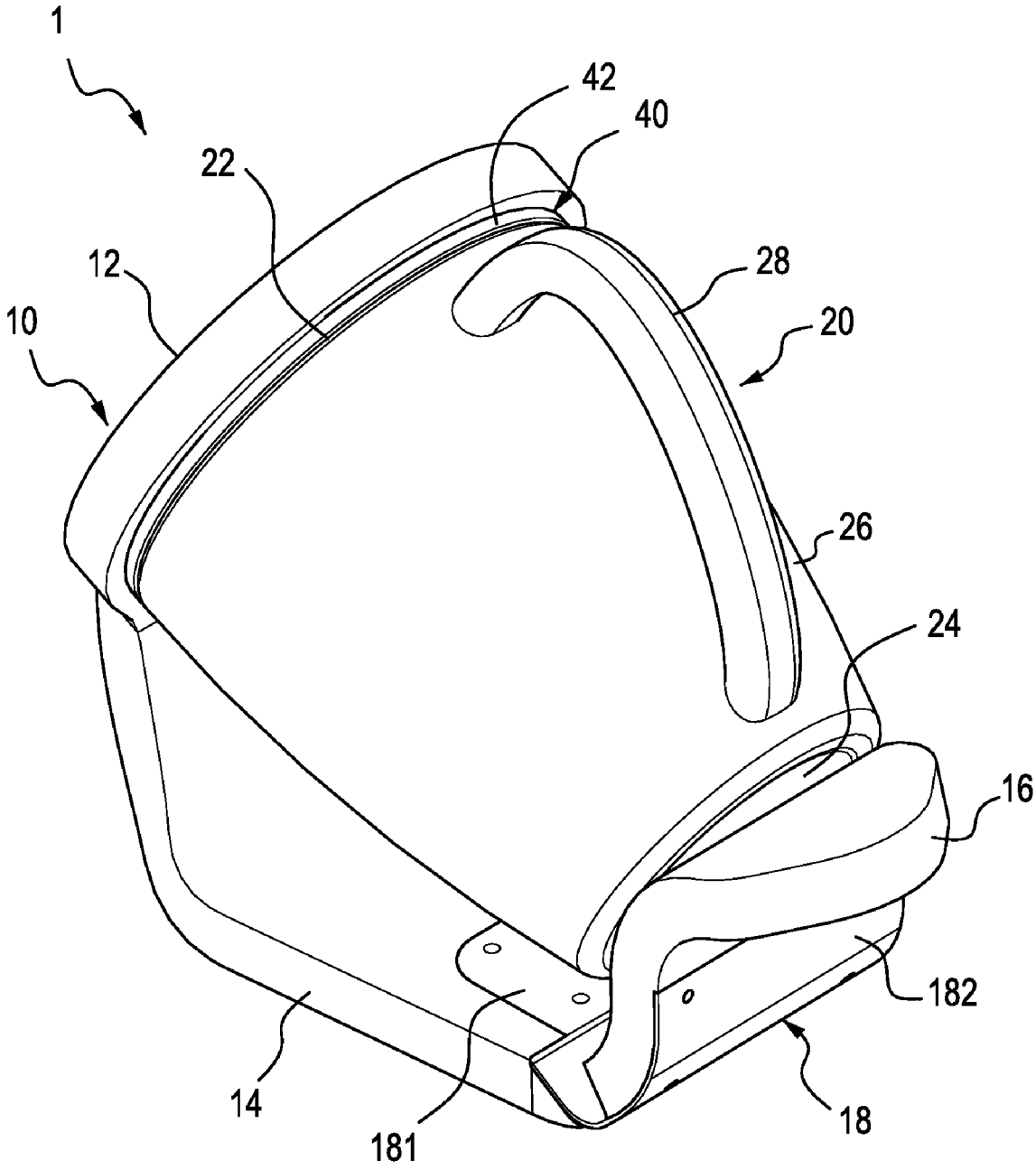
FIG. 2 is a perspective view of the first embodiment of the present invention.
Figure 3:
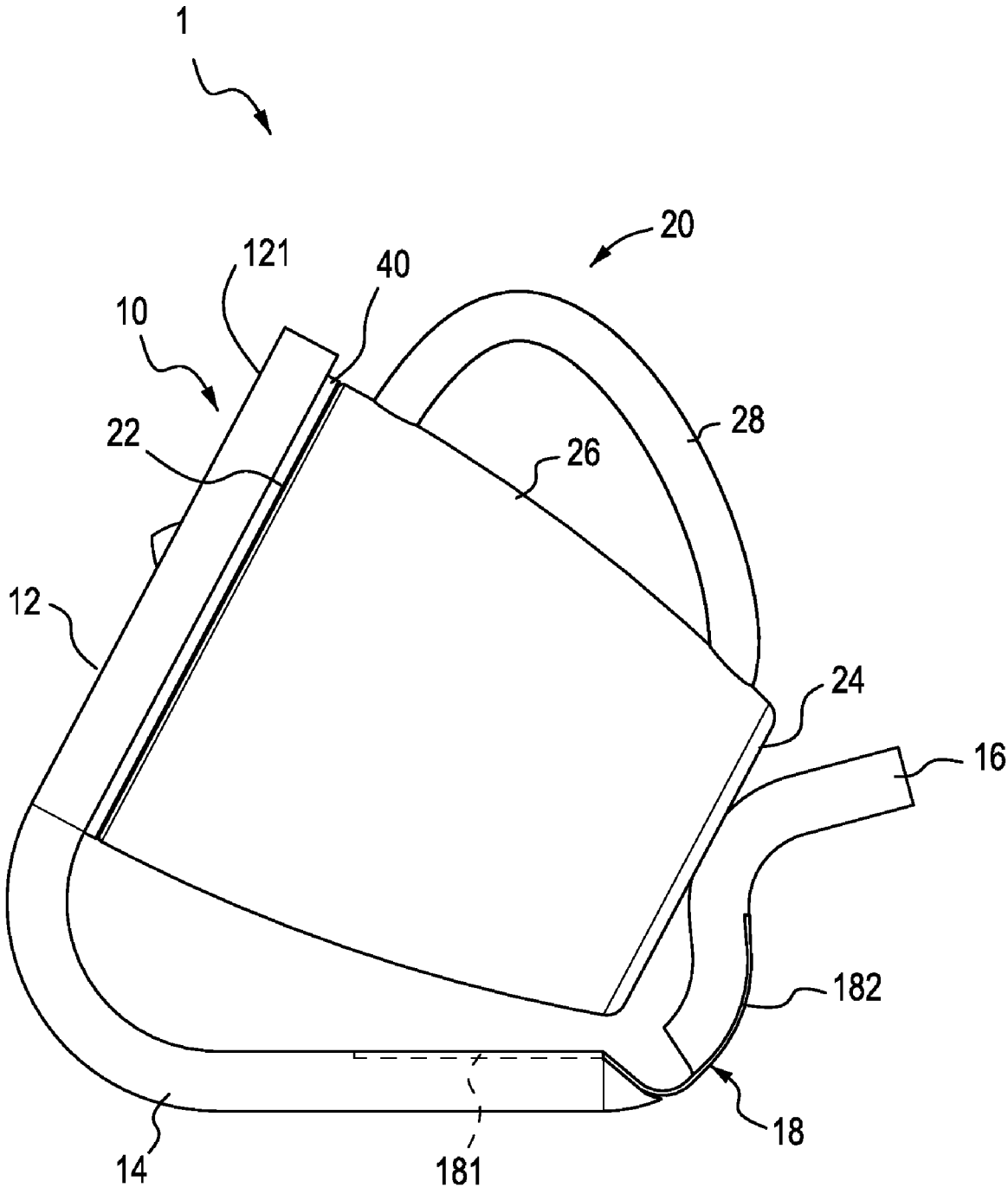
FIG. 3 is a side elevational view of the first embodiment of the present invention.
Figure 4:
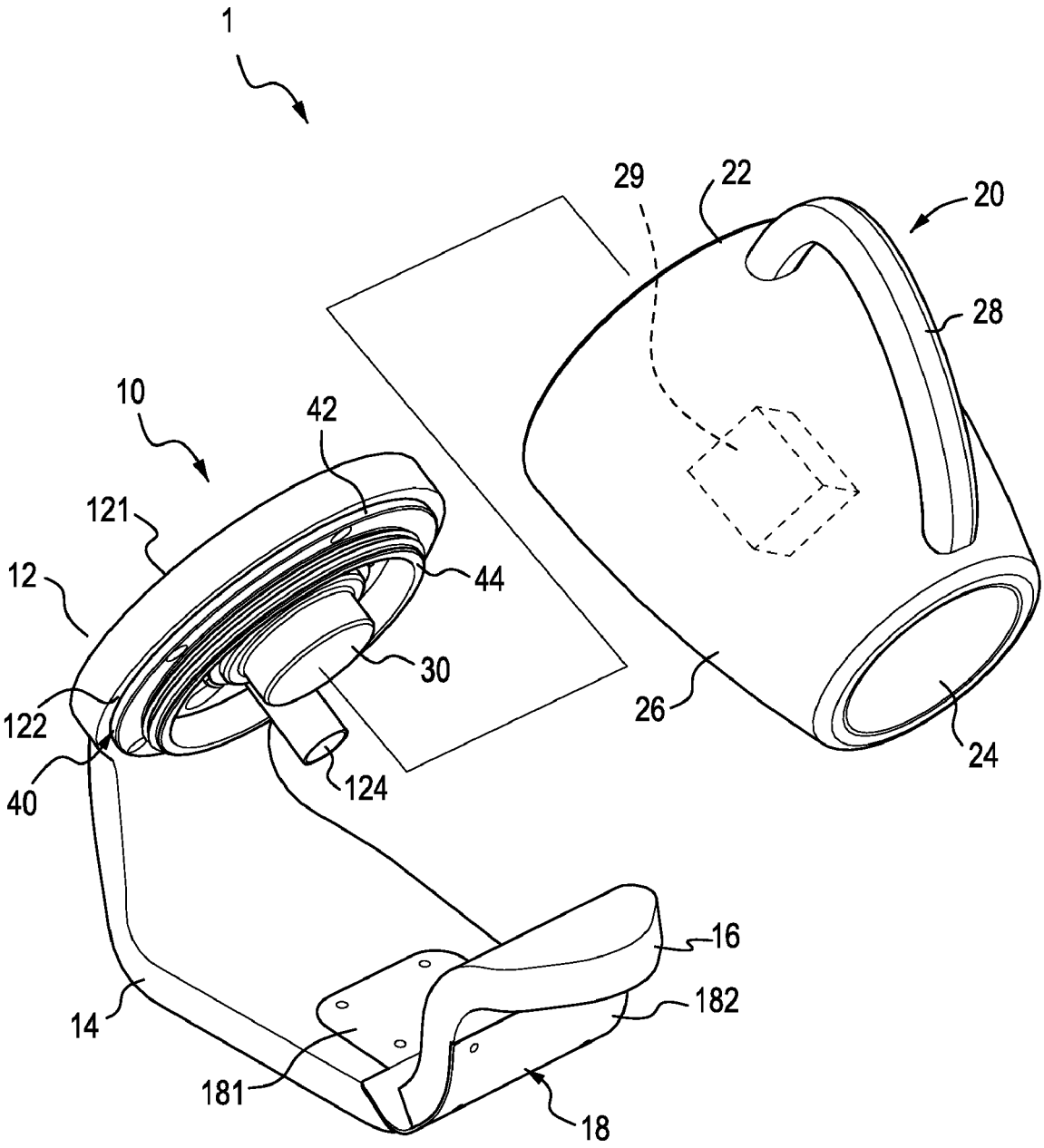
FIG. 4 is a schematic perspective view of the first embodiment of the present invention showing the cup detached from the baffling device.
Figure 5:
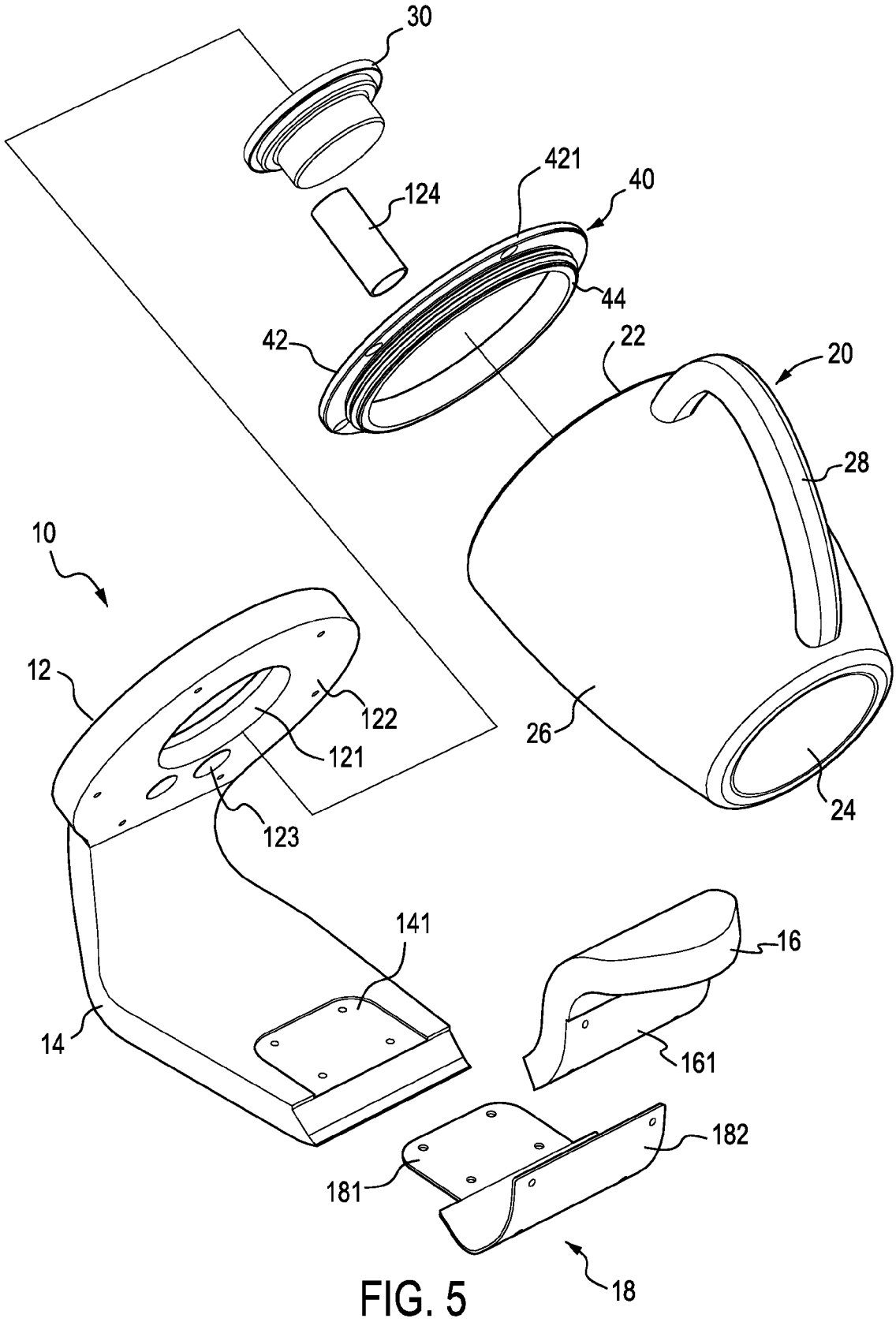
FIG. 5 is an exploded view of the first embodiment of the present invention.

With reference to FIGS. 2-5, the first embodiment of the present invention is a speaker structure 1. The speaker structure 1 mainly contains a cup 20 (food container) and a baffling device 10. The cup 20 has an open top 22, a bottom 24, a continuous circumferential wall 26 extending between the top 22 and the bottom 24, and a hollow space (not shown) therein. The cup 20 has a grip 28 attached to a side of the continuous circumferential wall 26 for the convenience of a user, so that he can remove the cup 20 from the baffling device 10 as well as replace the cup 20 on the baffling device 10. The baffling device 10 is for covering the open top 22 of the cup 20, and contains: a baffle 12 formed with an opening 121 therein for accommodating a speaker unit 30, a ring-shaped washer 40 for retaining the open top 22 of the cup 20, a support portion 14 connected with the baffle 12, and a biasing portion 16, connected with the support portion 14. The speaker unit 30 is electrically connected to a signal and power source (not shown) by leads (not shown) for generating sound. The ring-shaped washer 40 is attached to an inner side 122 of the baffle 12 and the biasing portion 16 is configured to retain the bottom 24 of the cup 20. The support portion 14 and the biasing portion 16 of the baffling device 10 are connected through a spring plate 18 and thereby the biasing portion 16 can resiliently bias the open top 22 of the cup 20 toward the baffle 12 of the baffling device 10 so that the cup 20 can be firmly attached to the baffling device 10. The cup 20 is removable from the baffling device 10, and when the cup 20 is attached to the baffling device 10, the cup 20 functions as a resonant box for the speaker unit 30, and when the cup 20 is removed from the baffling device 10, the cup 20 is for holding liquid nourishment in the hollow space.

The baffle 12 of the baffling device 10 is located higher than the biasing portion 16 of the baffling device 20 so that when the cup 20 is attached to the baffling device 10, the cup 20 is obliquely placed with its open top 22 located higher than its bottom 24 to prevent any residual liquid in the cup 20 from contaminating the speaker unit 30.

The baffle 12 of the baffling device 10 contains a through hole 123 therein, adjacent to the opening 121. The through hole 123 has a diameter smaller than that of the opening 121. A vent pipe 124 is placed in the through hole 123 so that the resonant box (cup 20) can produce an enhanced bass sound. The ring-shaped washer 40 contains a flange 42 having plural holes 421 therein so that fasteners (not shown) can be incorporated and it can be attached to the inner side 122 of the baffle 12. Alternatively, the ring-shaped washer 40 can be integrally formed with the baffle of the baffling device 10. The ring-shaped washer 40 also contains a ring portion 44 and the outer periphery of the ring portion 44 of the ring-shaped washer 40 is zigzag so that it can be tightly fitted with the open top 22 of the cup 20.

The spring plate 18 (please refer to FIGS. 3 and 5) contains a first section 181 and a second section 182 extending from the first section 181. The first section 181 of the spring plate 18 is generally flat and connected with a connecting area 141 on a topside of the support portion 14. The second section 182 of the spring plate 18 is generally curved to fit the shape of the biasing portion 16 and connected with the connecting area 161 on a bottom side of the biasing portion 16.

Furthermore, the cup 20 contains a piece of sponge 29, which is replaceable with a piece of cloth, a porous material or the like to serve as sound absorbing material when the cup 20 is attached to the baffling device 10, and is used for cleaning the cup 20 when the cup 20 is detached from the baffling device 10.

Figure 6:
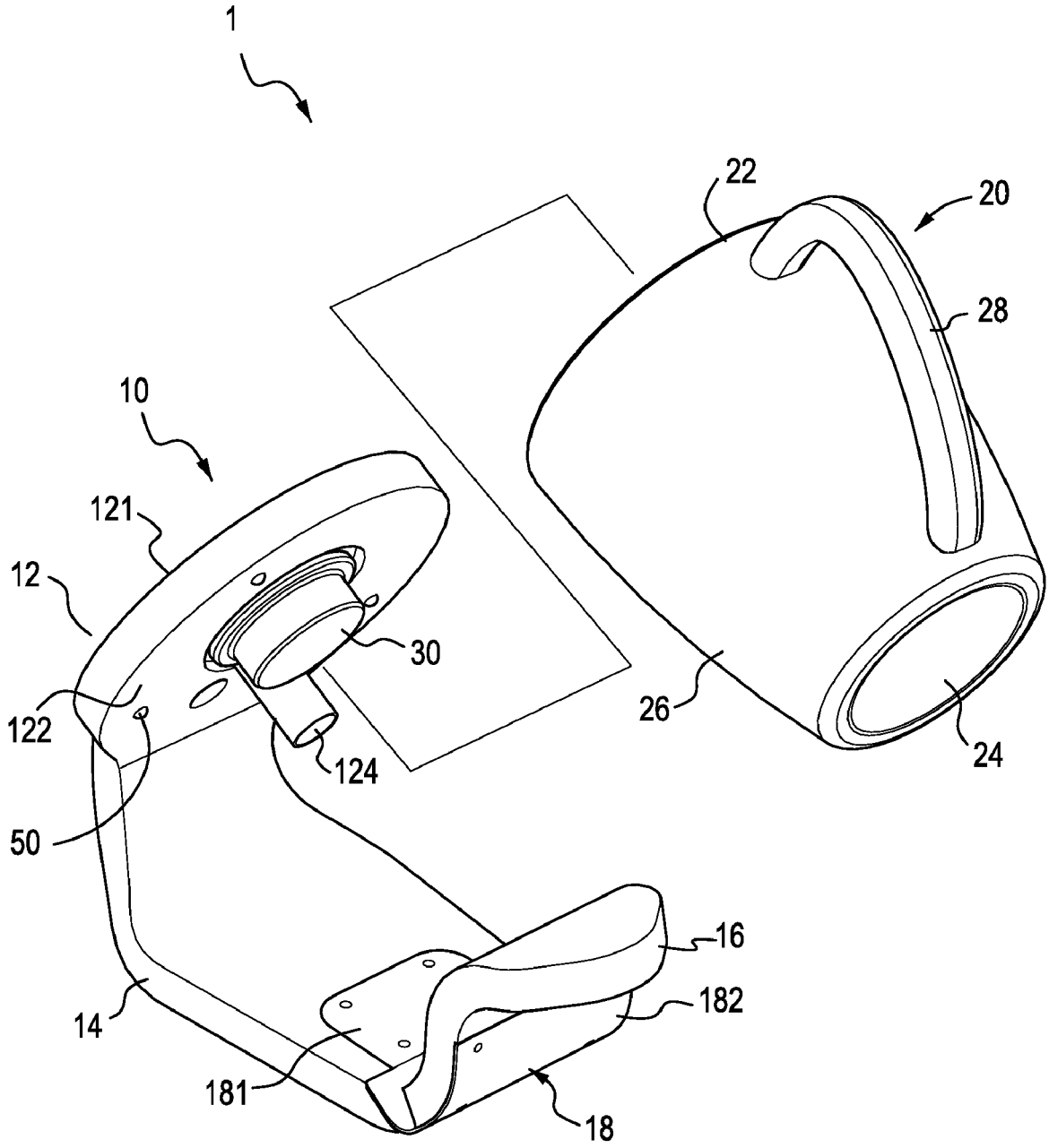
FIG. 6 is a schematic perspective view of the second embodiment of the present invention.

In a second embodiment of the present invention (please refer to FIG. 6) the ring-shaped washer 40 for retaining the open top 22 of the cup 20 is replaced by three equally spaced protrusions, which are also attached to the inner side 122 of the baffle 10. The three equally spaced protrusions are positioned against the inner periphery of the open top 22 of the cup 20 to retain the cup 20.

Figure 7:
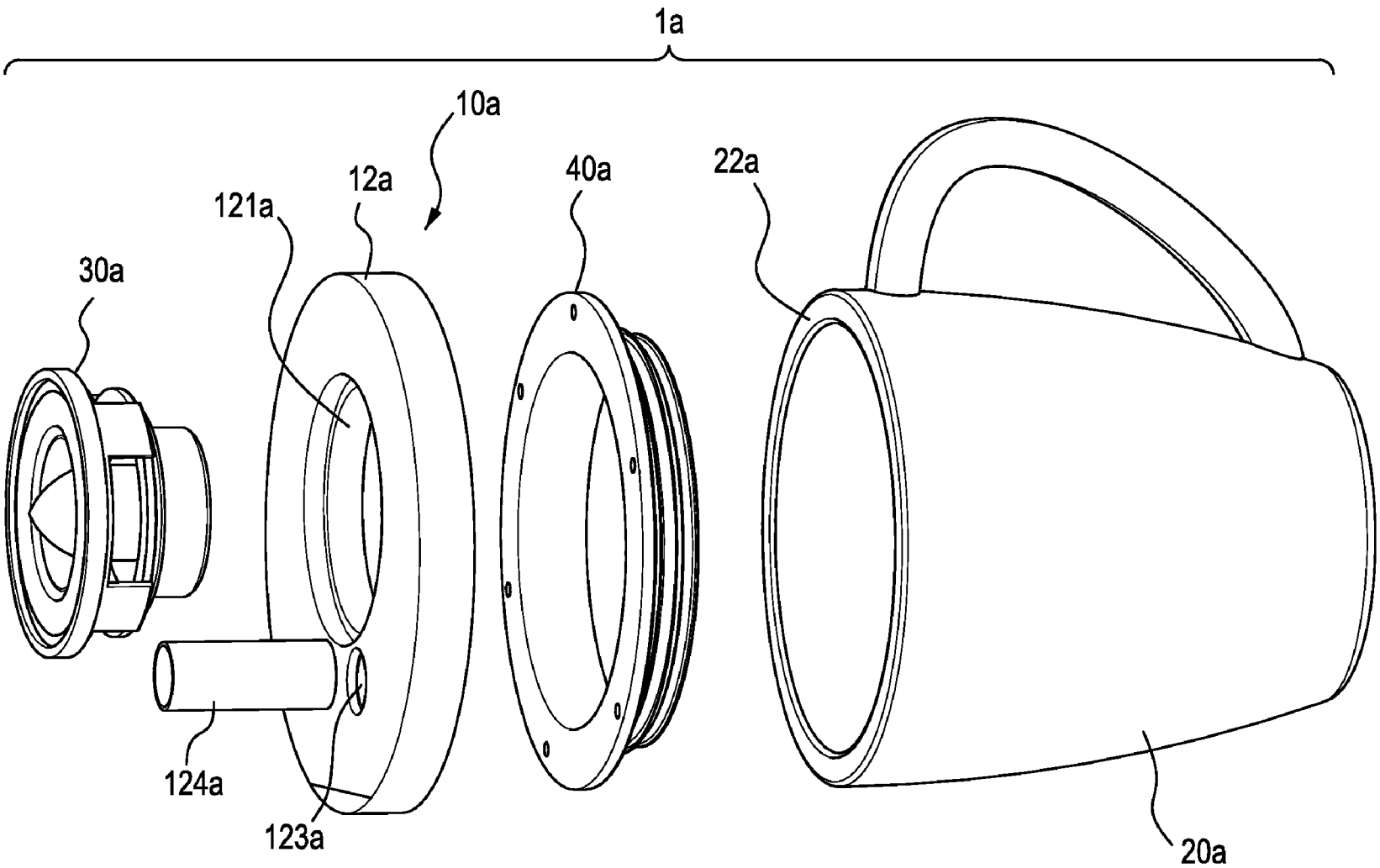
FIG. 7 is an exploded view of the third embodiment of the present invention.

With reference to FIG. 7, the third embodiment of the present invention is a speaker structure 1*a* comprising a cup 20*a* and a baffling device 10*a*. The baffling device 10*a* is for covering said open top 22*a* of said food container 20*a* and comprises a baffle 12*a* formed with an opening 121*a* therein for accommodating a speaker unit 30*a*, and a ring-shaped washer 40*a* for retaining the open top 22*a* of the cup 20*a*. The structure of the cup 20*a* is the same as that of the first embodiment. The ring-shaped washer 40*a* is attached to an inner side of the baffle 12*a*. The baffle 12*a* of the baffling device 10*a* contains a through hole 123*a* adjacent to said opening 121*a*. The diameter of the through hole 123*a* is smaller than that of the opening 121*a*. An aluminum vent pipe 124*a* is positioned in the through hole 123*a* to enhance the bass effect.

Figure 8:
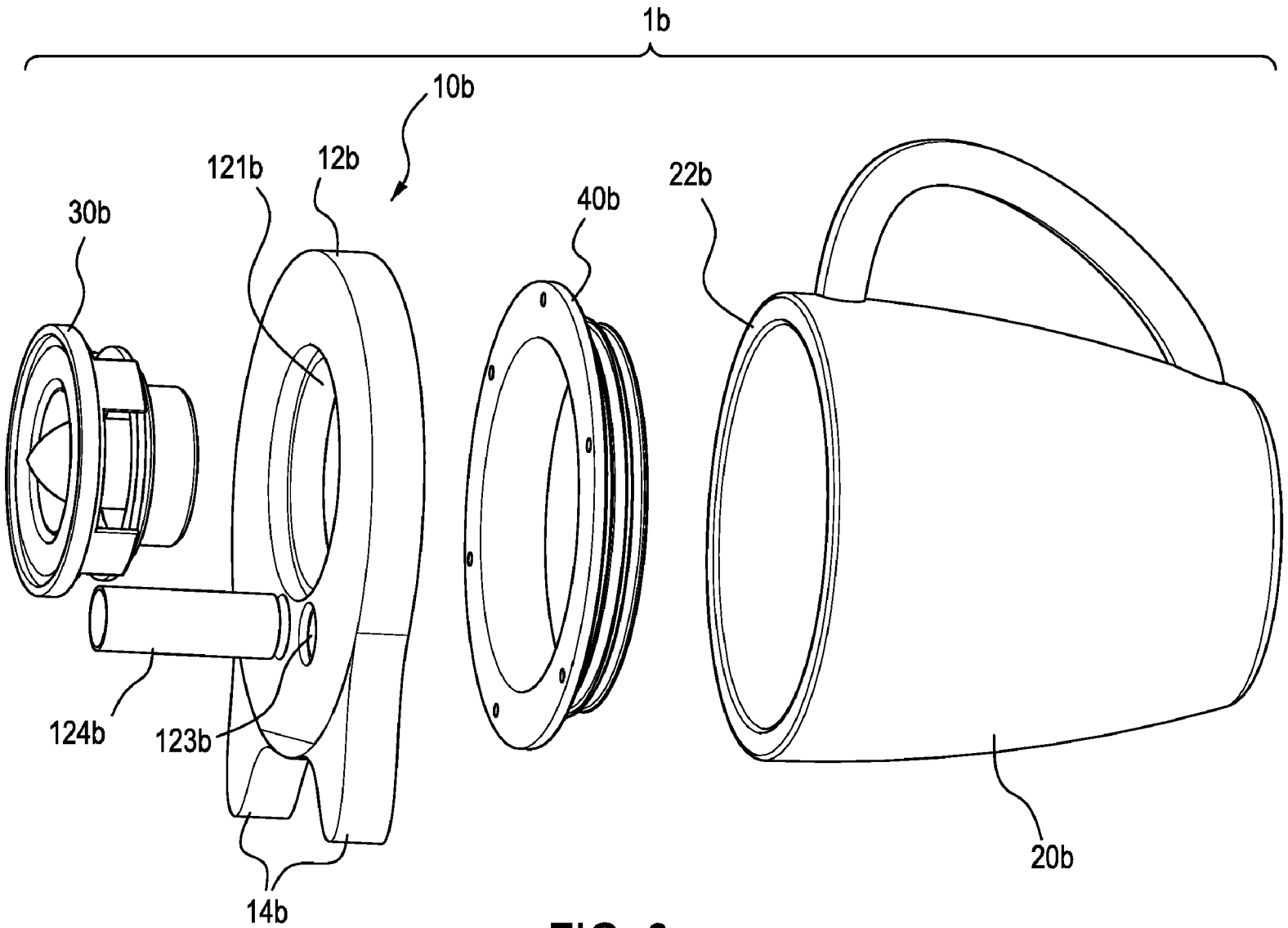
FIG. 8 is an exploded view of the fourth embodiment of the present invention.
Figure 9:
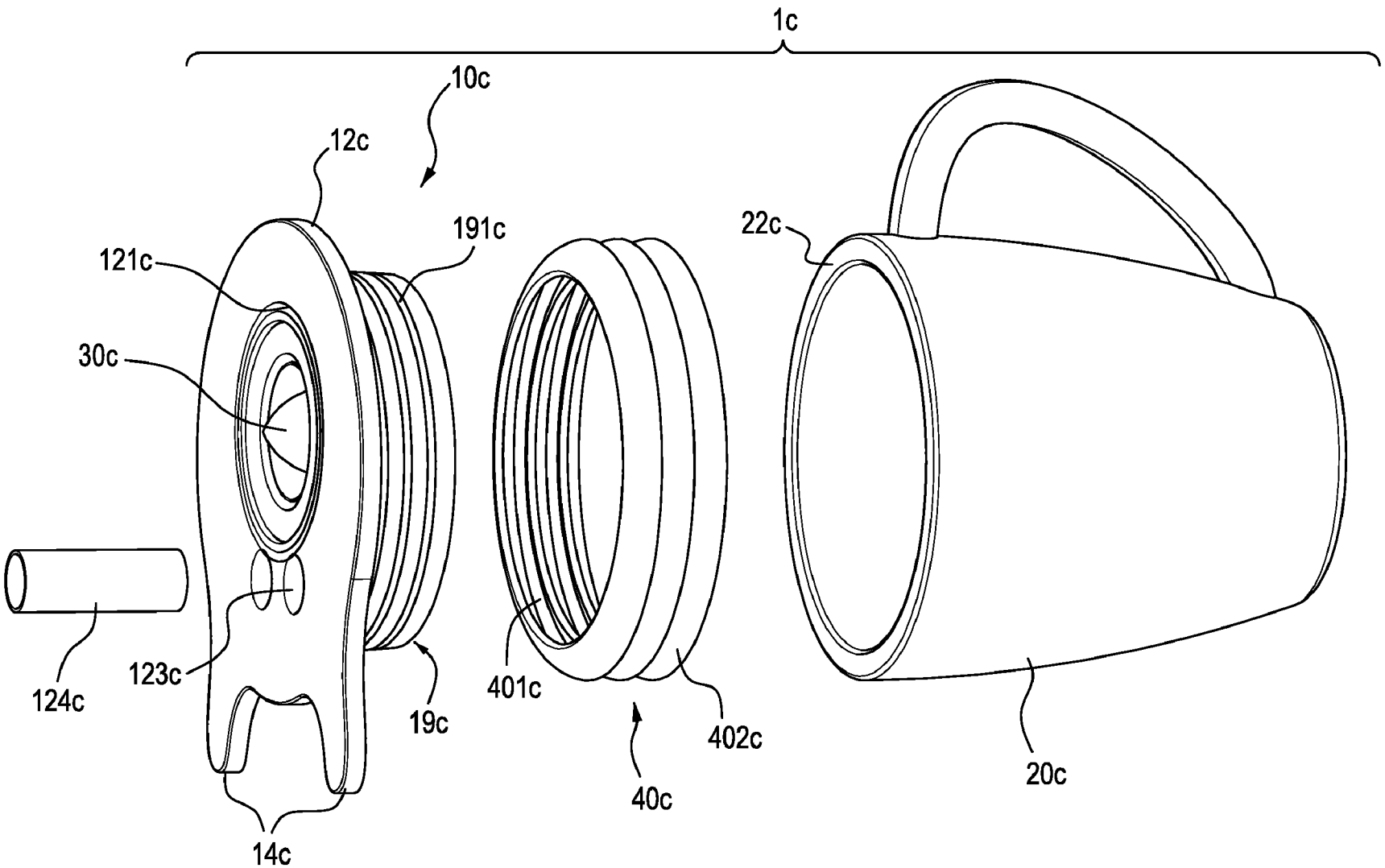
FIG. 9 is an exploded view of the fifth embodiment of the present invention.

With reference to FIG. 8, the fourth embodiment of the present invention is a speaker structure 1*b* comprising a cup 20*b* and a baffling device 10*b*. The baffling device 10*b* is for covering said open top 22*b* of said food container 20*b* and comprises a baffle 12*b* formed with an opening 121*b* therein for accommodating a speaker unit 30*b*, and a ring-shaped washer 40*b* for retaining the open top 22*b* of the cup 20*b*. The structure of the cup 20*b* is the same as that of the first embodiment. The ring-shaped washer 40*b* is attached to an inner side of the baffle 12*b*. The baffle 12*b* of the baffling device 10*b* contains a through hole 123*b* adjacent to said opening 121*a*. The diameter of the through hole 123*b* is smaller than that of the opening 121*b*. An aluminum vent pipe 124*b* is positioned in the through hole 123*a* to enhance the bass effect. There are two legs 14*b* extending downward from a bottom edge of the baffle 12*b* for supporting the baffling device 10*b*.

With reference to FIG. 8, the fourth embodiment of the present invention is a speaker structure 1*c* comprising a cup 20*c* and a baffling device 10*c*. The baffling device 10*c* is for covering said open top 22*c* of said food container 20*c* and comprises a baffle 12*c* formed with an opening 121*c* therein for accommodating a speaker unit 30*c*, and a means for retaining the open top 22*c* of the cup 20*c*. The structure of the cup 20*c* is the same as that of the first embodiment. The means comprises an annular flange 19*c* fixed to an inner side of said baffle 12*c* and a separate annular washer 40*c*. The annular flange 19*c* has a threaded outer circumference 191*c* so that it can be detachably engaged with a threaded inner circumference 401*c* of said annular washer 40*c*. The annular washer 40*c* comprises a waved surface 402*c* so that it can be tightly fitted with said open top 22*c* of said cup 20*c*. An aluminum vent pipe 124*c* is positioned in the through hole 123*c* to enhance the bass effect. There are two legs 14*c* extending from a bottom edge of the baffle 12*c* to support the baffling device 10*c*.

In modern daily life, small sized audio systems or computer speakers are necessary commodities in people's office or houses. Food containers such as cups, bottles and cans can be seen everywhere. However, a speaker and a food container belong to two different fields and it's non-obvious or difficult to relate or combine the two. The subject invention provides an eco-product, which is also very convenient. As described above, the subject invention serving multiple purposes makes prominent improvements and significant progresses to conventional food containers and speakers that only serve single purpose.

The invention may also be implemented in other specific modes without departing from the spirit and the essence of the invention. Thus, the above-mentioned embodiments shall be regarded as explanatory but not restrictive. All changes consistent with the meaning and range of the claims and their equivalents shall fall within the scope claimed by the invention. For instance, the cup 20 in the aforementioned embodiments can be replaced by any kind of food container, such as a bowl, a jar or a bottle, and the material of the food container can be of any kind, such as china or metal.

I claim:

1. A speaker structure comprising:

a speaker unit;

a food container, having an open top, a bottom, a continuous circumferential wall extending between the top and the bottom, wherein said open top, said bottom, and said continuous circumferential wall together defines a hollow space therein; and a baffling device, comprising:

a baffle, covering said open top of said food container, having an opening formed therein for accommodating said speaker unit; and means for retaining said open top of said food container, which is detachably attached to an inner side of said baffle, wherein said food container is removable from said baffling device, and when said food container is attached to said baffling device, said food container is adapted to work as a resonant box for said speaker unit and when said food container is detached from said baffling device, said food container is adapted to hold food in said hollow space.

2. The speaker structure of claim 1, further comprising a support portion connected with said baffle for supporting said speaker structure.

3. The speaker structure of claim 2, further comprising a biasing portion connected with said support portion, said biasing portion being configured to retain said bottom of said food container and resiliently biasing the open top of the food container toward the baffle of the baffling device, so that said food container can be firmly attached to the baffling device.

4. The speaker structure of claim 3, wherein said biasing portion of said baffling device is connected with said support portion of said baffling device through a spring plate.

5. The speaker structure of claim 4, wherein said baffle of said baffling device is located higher than said biasing portion of said baffling device.

6. The speaker structure of claim 4, further comprising a vent pipe, said baffle of said baffling device having a through hole therein, said through hole being adjacent to said opening of said baffle, and said vent pipe being positioned in said through hole.

7. The speaker structure of claim 4, wherein said means for retaining said open top of said food container is integrally formed with said baffle of said baffling device.

8. The speaker structure of claim 4, wherein said means for retaining said open top of said food container is in the form of a ring-shaped washer, said open top of said food container being retained by an outer periphery of said ring-shaped washer.

9. The speaker structure of claim 8, wherein said ring-shaped washer has a flange having plural holes therein so that fasteners can be incorporated and it can be attached to said inner side of said baffle, and said outer periphery of said ring-shaped washer is zigzag so that it can be tightly fitted with said open top of said food container.

10. The speaker structure of claim 4, wherein said means for retaining said open top of said food container is composed of at least one protrusion.

11. The speaker structure of claim 2, wherein said food container is a cup.

12. The speaker structure of claim 9, further comprising a piece of sponge, which is disposed within the food container to serve as sound-absorbing material when the food container is attached to the baffling device, and is used for cleaning the food container when the food container is detached from the baffling device.

13. The speaker structure of claim 1, further comprising a support portion having two legs extending downward therefrom.

14. The baffling device of claim 13, further comprising a vent pipe, said baffle of said baffling device having a through hole therein, said through hole being adjacent to said opening of said baffle, and said vent pipe being positioned in said through hole.

15. The baffling device of claim 14, wherein said means for retaining said open top of said food container is in the form of a ring-shaped washer, said open top of said food container being retained by an outer periphery of said ring-shaped washer.

16. The baffling device of claim 15, wherein said ring-shaped washer has a flange having plural holes therein so that fasteners can be incorporated and it can be attached to said inner side of said baffle, and said outer periphery of said ring-shaped washer is zigzag so that it can be tightly fitted with said open top of said food container.

17. The baffling device of claim 13, wherein said means for retaining said open top of said food container comprises a annular flange fixed to said inner side of said baffle, and a separate annular washer, said annular flange having a threaded outer circumference so that it can be detachably engaged with a threaded inner circumference of said annular washer.

18. The baffling device of claim 17, wherein said annular washer comprises a waved surface so that it can be tightly fitted with said open top of said food container.

* * * * *